US006604474B2

(12) United States Patent
Zamansky et al.

(10) Patent No.: US 6,604,474 B2
(45) Date of Patent: Aug. 12, 2003

(54) MINIMIZATION OF $NO_X$ EMISSIONS AND CARBON LOSS IN SOLID FUEL COMBUSTION

(75) Inventors: Vladimir Zamansky, Oceanside, CA (US); Vitali Victor Lissianski, San Juan Capistrano, CA (US); Peter Martin Maly, Lake Forest, CA (US); Yuri Mikhailovloh Mospan, Binnitskaya Oblast (UA)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/852,913

(22) Filed: May 11, 2001

(65) Prior Publication Data

US 2002/0166484 A1 Nov. 14, 2002

(51) Int. Cl.[7] ..... F23B 7/00; F23J 11/00

(52) U.S. Cl. ..... 110/342; 110/345; 110/201; 110/204; 110/304; 110/210; 110/216

(58) Field of Search ..... 110/201, 203, 110/204, 301, 302, 303, 304, 210, 211, 216, 342, 345, 347

(56) References Cited

U.S. PATENT DOCUMENTS 4,250,820 A * 2/1981 Lautenschlager ..... 110/347
4,253,409 A * 3/1981 Wormser ..... 110/347
4,501,204 A * 2/1985 McCartney et al. ..... 110/264
4,532,872 A * 8/1985 Anderson ..... 110/255
4,699,071 A * 10/1987 Vier et al. ..... 110/345
4,739,713 A * 4/1988 Veir et al. ..... 110/263
4,915,039 A * 4/1990 Ringel ..... 110/346
4,926,765 A * 5/1990 Dreizler et al. ..... 110/234
5,154,599 A * 10/1992 Wunning ..... 431/215
5,195,450 A * 3/1993 Marion ..... 110/347
5,347,958 A * 9/1994 Gordon ..... 122/20
5,425,317 A * 6/1995 Schaub et al. ..... 110/346
5,626,088 A * 5/1997 Hiltunen et al. ..... 110/243
5,915,310 A * 6/1999 Hura et al. ..... 110/345
5,934,892 A 8/1999 Rabovitser et al.
5,937,772 A * 8/1999 Khinkis et al. ..... 110/345
5,967,061 A * 10/1999 Ashworth et al. ..... 110/203
6,039,560 A * 3/2000 Kubota ..... 431/9
6,058,855 A * 5/2000 Ake et al. ..... 110/214
6,085,674 A 7/2000 Ashworth
6,199,494 B1 * 3/2001 Griffin ..... 110/348
6,206,685 B1 3/2001 Zamansky et al.
6,244,200 B1 * 6/2001 Rabovitser ..... 110/347
6,325,002 B1 12/2001 Ashworth
6,325,003 B1 12/2001 Ashworth et al.

* cited by examiner

*Primary Examiner*—Ira S. Lazarus
*Assistant Examiner*—K B. Rinehart
(74) *Attorney, Agent, or Firm*—Nixon & Vanderhye P.C.

(57) ABSTRACT

This invention discloses the synergistic integration of solid fuel combustion, low NOx control technologies (such as Low NOx Burners, reburning and Advanced Reburning) with partial in-duct gasification of coal or other solid fuels. For partial gasification, the solid fuel can be transported and injected by recycled flue gas stream at 600–800° F. in the reburning zone or in the upper section of the main combustion zone of a boiler. This allows the fuel to be preheated and partially pyrolyzed and gasified in the duct and then injected into the boiler as a mixture of coal, gaseous products, and char. Gasification increases coal reactivity and results in lower carbon-in-ash levels. As an option, the gaseous and solid products can be split using a cyclone separator. Splitting the gasified fuel stream will allow the volatile matter to be used for reburning and the fixed carbon to be injected into the high-temperature main combustion zone.

18 Claims, 2 Drawing Sheets

MINIMIZATION OF $NO_X$ EMISSIONS AND CARBON LOSS IN SOLID FUEL COMBUSTION

BACKGROUND OF THE INVENTION

This invention relates to solid fuel combustion systems and, specifically, to an improved method for achieving minimization of NOx emissions and carbon loss in solid fuel combustion in boilers, furnaces and the like.

Regulatory requirements for low emissions from gas turbine power plants have increased over the past 15 years. Environmental agencies throughout the world are requiring even lower rates of emissions of NOx and other pollutants from both new and existing power plants.

For coal (or other solid fuel) fired boilers in power generating plants, a range of NOx control technologies is available. Currently, two approaches are widely used in coal-fired boilers: Selective Catalytic Reduction (SCR) and Combustion Modification.

SCR involves injection of ammonia and its reaction with NOx on the surface of a catalyst. SCR systems can be designed for most boilers and may be the only approach for high NOx units such as cyclones. However, SCR retrofits are often complex with fan upgrades and major duct modifications resulting in high initial capital cost. Catalyst life is uncertain and the catalyst continues to degrade when NOx control is not required (7 months per year) unless a bypass is installed with additional capital cost. On the other hand, SCR economics are favorably influenced by increasing size.

As an alternative to SCR, Combustion Modification achieves deep NOx control by integrating several components:

Low NOx Burners (LNB)—Decrease NOx emissions by utilizing fuel and air staging inside the burner. This is typically the lowest cost Combustion Modification technique and is usually applied as the first step towards low cost deep NOx control.

Overfire Air—(OFA)—The addition of air into an upper level of the combustor can reduce NOx by an additional ~25% from LNB.

Reburning—Reburning involves injecting additional fuel above the existing burner zone followed by OFA for burnout and CO control. Reburning can effectively reduce NOx by up to 60% from LNB levels depending on site-specific factors and the amount of reburn fuel injected. The reburning fuel can be natural gas, oil, micronized coal, biomass, etc.

Advanced Reburning (AR)—AR is a combination of reburning and Selective Non-Catalytic Reduction (SNCR). AR can reduce NOx an additional 50% without ammonia slip problems. The N-agent (ammonia or urea) can be injected in a number of configurations selected to optimize overall performance of the reburning and SNCR components at minimum overall cost.

However, low NOx burners and coal reburning generally increase carbon content in ash. This is because staging in low NOx burners does not provide ample residence time for coal particles injected at the upper level burners to completely burnout. Operating conditions for coal reburning are also not suitable for complete combustion of carbon. Therefore, there is a key need for minimization of carbon-in-ash for low NOx technologies.

As mentioned above, many combustion modification techniques can cause flyash carbon to increase to unacceptable levels. In numerous examples, the retrofit of LNB to existing boilers has resulted in increased carbon-in-ash and consequently combustion efficiency losses. The unburned carbon represents a few percent of total fuel consumption. Additionally, productive uses of carbon enriched flyash are limited, and high carbon ash is more expensive to dispose of. A typical use for flyash is as an additive in concrete. Flyash can react with lime providing improved concrete properties, such as additional strength, lower water content, lower heat of hydration, and lowest cost. However, high carbon ash is not usable in concrete. The standard specifications call for less than 6% carbon-in-ash, although some specific projects require as low as 3%.

The challenge is to minimize carbon loss while also minimizing NOx emissions. Two methods have been demonstrated for reducing carbon-in-ash under low NOx conditions. The first method is the reduction of coal particle size, and the second is natural gas reburning (GR). Although particle size reduction is an effective method of reducing carbon loss in low NOx systems, this technique usually requires expensive modifications or complete replacement of the pulverizing equipment.

Although gas reburning is a proven technology for effective NOx reduction and reducing carbon losses, the cost of gas is significantly higher than the cost of the main fuel, coal. For reburning or AR using natural gas, the differential cost of the reburn fuel is a key cost element, often comprising more than half of the total cost of the NOx control system. The differential cost of the reburning fuel can be eliminated by reburning with the same fuel normally fired in the boiler, i.e., coal. Unfortunately, it is difficult to achieve complete burnout of the reburn coal due to the lack of oxygen in the reburning zone and the low temperature in the burnout zone once OFA is injected. Thus, while the differential cost of the reburn fuel is eliminated, there is a reduction in combustion efficiency and the resulting high carbon ash cannot be sold and must be disposed at additional cost. Therefore, an ideal situation would be to utilize LNB, coal reburning, advanced coal reburning, and other technologies that utilize fuel-rich and fuel-lean zones to reduce NOx emissions, but at the same time mitigate the problem associated with the increase of carbon-in-ash.

BRIEF SUMMARY OF THE INVENTION

This invention discloses a method for minimizing carbon-in-ash while providing high efficiency NOx control for solid fuel combustion. As mentioned earlier, the main problem with LNB technology is that carbon-in-ash can increase to unacceptable levels, reducing efficiency and precluding utilization of the ash by the cement industry.

In the first embodiment of this invention, partially gasified coal (or other solid fuel) is injected into the upper level burner(s) in coal-fired boilers. For partial in-duct coal gasification, the coal can be transported and injected by a recycled flue gas stream at 600–900° F. This allows the coal particles to be preheated and partially pyrolyzed and gasified in the duct and then injected into the boiler as a mixture of coal, gaseous product, and char. Conditions suitable for avoiding accumulation of tar in the duct have been identified.

As an option, carbon-in-ash can also be reduced by cyclone separation of the gaseous and solid products prior to injection into the upper level burners. Indeed, coal typically consists of approximately equal fractions of volatile matter and fixed carbon. Splitting the fuel stream will allow the volatile matter to be used at the upper level burners in the primary combustion zone, and the fixed carbon to be injected into the lower level burners.

In a second embodiment, partially gasified coal can be injected into a reburning zone downstream of the primary combustion zone, followed by OFA injection in the burnout zone (downstream of the reburning zone). The solid residue also can optionally be injected into the main combustion zone. Also optionally, only small amounts of gasification products can be injected into the reburning zone, with remaining products and solid residue injected into the main combustion zone. At low amounts of gasification products in the reburning zone, its stoichiometry remains fuel-lean and no OFA needs to be injected to complete combustion.

Thus, in accordance with one aspect of the invention, there is provided a method of decreasing concentration of nitrogen oxides and carbon loss in a combustion flue gas comprising a) providing a boiler having a combustion zone; b) providing a plurality of burners in a lower level of the combustion zone and one or more burners in an upper level of the combustion zone; c) injecting combustible solid fuel and an oxidizing agent into the plurality of burners in the lower level of the combustion zone; d) injecting partially gasified solid fuel into at least one of the one or more burners in the upper level of the combustion zone.

In another aspect, the invention relates to a method of decreasing concentration of nitrogen oxides and carbon loss in a combustion flue gas comprising: a) a combustion zone including a primary zone, a reburning zone and a burnout zone; b) providing a plurality of burners in the primary zone; c) injecting a combustible solid fuel and an oxidizing agent into the plurality of burners in the primary zone; and d) injecting partially gasified coal into the reburning zone, downstream of the primary zone. Overfire air may be added to the burnout zone, downstream of the reburning zone.

In still another aspect, the invention relates to a method of decreasing concentration of nitrogen oxides and carbon loss in a combustion flue gas comprising a) providing a boiler having a combustion zone; b) providing a plurality of burners in a lower level of the combustion zone and one or more burners in an upper level of the combustion zone; c) injecting coal and an oxidizing agent into the plurality of burners in the lower level of the combustion zone to produce a combustion flue gas; and d) injecting partially gasified coal into at least one of the one or more burners in the upper level of the combustion zone; wherein step d) is achieved by mixing coal particles with recirculating flue gas; and wherein the flue gas is at 600–900° F.

In still another aspect, the invention relates to apparatus for minimizing NOx emissions and carbon loss in solid fuel combustion comprising a boiler having an inlet, a combustion zone, and an outlet; a plurality of burners arranged in a lower level of the combustion zone and one or more burners in an upper level of the combustion zone; means for supplying air and solid fuel to the plurality of burners in the lower level of the combustion zone; and means for supplying partially gasified solid fuel to at least one of the one or more burners in the upper level of the combustion zone.

In still another aspect, the invention relates to apparatus for minimizing NOx emissions and carbon loss in solid fuel combustion comprising: a boiler having an inlet, a combustion zone, and an outlet wherein the combustion zone includes a primary zone, a reburning zone and a burnout zone; a plurality of burners arranged in said primary zone; means for supplying air and solid fuel to the plurality of burners in the primary zone; and means for supplying partially gasified solid fuel to the reburning zone. Means may also be provided for supplying overfire air to the burnout zone, downstream of the reburning zone.

DETAILED DESCRIPTION OF THE INVENTION

Figure 1:
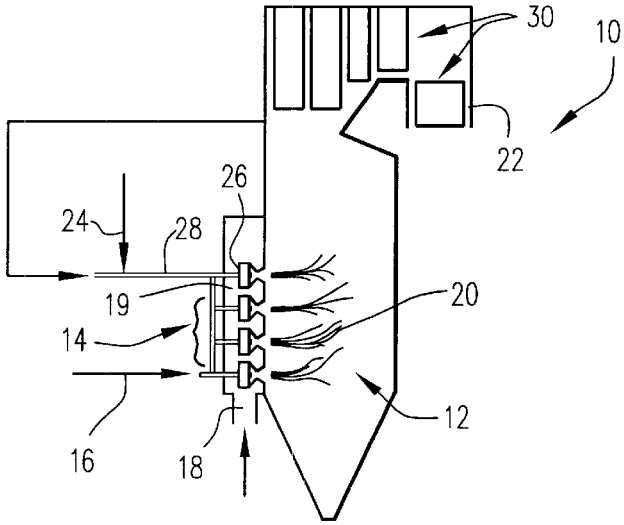
FIG. 1 is a schematic diagram of a partial induct coal gasification arrangement in accordance with a first embodiment of the invention.

With reference to FIG. 1, a coal fired boiler 10 includes a combustion zone 12. The combustion zone 12 is provided with a plurality of burners 14 (four shown) that are supplied with coal via fuel inlet 16, and air through an air inlet 18 and associated air manifold 19. The main fuel, e.g., coal, is burned in burners 14 in the presence of air in the lower level of the combustion zone 12 to form a combustion flue gas 20 that flows in a downstream direction from the combustion zone 12 toward an outlet 22. Partially gasified coal (or other solid fuel) is injected via input 24 into one or more burners 26 (one shown) in the upper level of the combustion zone, also mixing with air supplied to all the burners from manifold 19. For partial in-duct coal gasification, the coal can be transported and injected into at least one of the one or more burners 26 by a recycled flue gas via stream 28 at 600–900° F. This allows the coal particles (which may be of the same size as the coal introduced at the fuel inlet 16) to be preheated, partially pyrolyzed and gasified in the duct or stream 28 before injection into the combustion zone 12 of the boiler 10 as a mixture of coal, gaseous products and char. More complete burning of the carbon reduces carbon loss while still minimizing NOx emissions. The resultant flue gases pass through a series of heat exchangers 30 or other energy recovery devices before exhausting to atmosphere.

Figure 2:
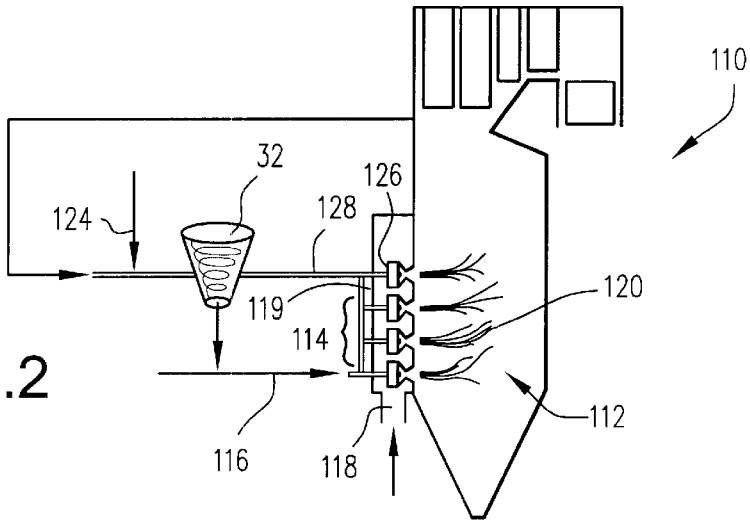
FIG. 2 is a schematic diagram of a partial induct coal gasification arrangement in accordance with an optional configuration of a first embodiment of the invention.

Turning to FIG. 2, an alternative arrangement is shown and, for convenience, similar reference numerals, with the prefix "1" added, are used to identify corresponding components. In this embodiment, carbon-inash is further reduced by cyclone separation of the gaseous and solid products in the duct or stream 128, prior to injection into the upper level burner(s) 126 in the combustion zone 112. Specifically, a cyclone separator 32 is located in the stream 126, downstream of the coal injection input at 124, so that volatile matter will be mixed with combustion air from manifold 119 and injected into at least one of the one or more upper level burners 126 for burning in the combustion zone 112, while the char or fixed carbon is injected into the lower level burners 114 with the main fuel in line 116. This approach has two main benefits. First, the volatile matter introduced into the upper level of the combustion zone 112 has enough residence time for complete carbon burnout. Second, fixed carbon is primarily responsible for high carbon-in-ash levels during coal combustion in LNB. Splitting off the char fraction and conveying it to the lower level burners 114 in the combustion zone 112 provides longer residence time and higher carbon combustion efficiency. These in-duct gasification approaches will enable effective commercial application of ash from LNB.

Figure 3:
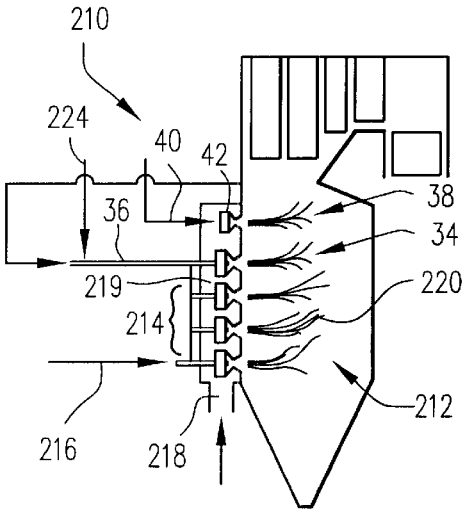
FIG. 3 is a schematic diagram of a partial induct coal gasification arrangement in accordance with a second embodiment of the invention.

FIG. 3 illustrates still another embodiment and, here again, for convenience, similar reference numerals with the prefix "2" added, are used to identify corresponding components. In this embodiment, coal or other solid fuel injeted via line 216 is burned in burners 214 located in the main or primary combustion zone 212 in the lower portion of the boiler, while partially gasified coal is injected into and burned in a reburning zone 34 (downstream of the main or primary zone 212) via stream 36, with overfire air (OFA) injected into a burnout zone 38 (downstream of the reburning zone) via stream 40 and air port 42. Solid residue from the partially gasified coal may be optionally injected into the main combustion zone 212 via a cyclone as shown in FIG. 2. Increased residence times achieves more complete burnout of carbon, thus reducing carbon loss. For low amounts of gasification products in the reburning zone, no OFA injection is required since the stoichiometry remains fuel-lean.

In each of the three embodiments described above, wall-fired boilers are employed. The invention, however, is applicable to all boiler firing configurations.

Experiments—A series of tests were conducted to evaluate performance of the partial in-duct gasification approach described above. The tests were conducted in a $1.0\times10^6$ Btu/hr Boiler Simulator Facility (BSF) using natural gas as the primary fuel and coal as the secondary, downstream injected fuel. The objective was to determine whether preheating and partially gasifying the coal would lead to performance improvements. Tests were conducted in the reburning mode, providing fuel rich conditions in the area of secondary fuel injection.

Figure 4:
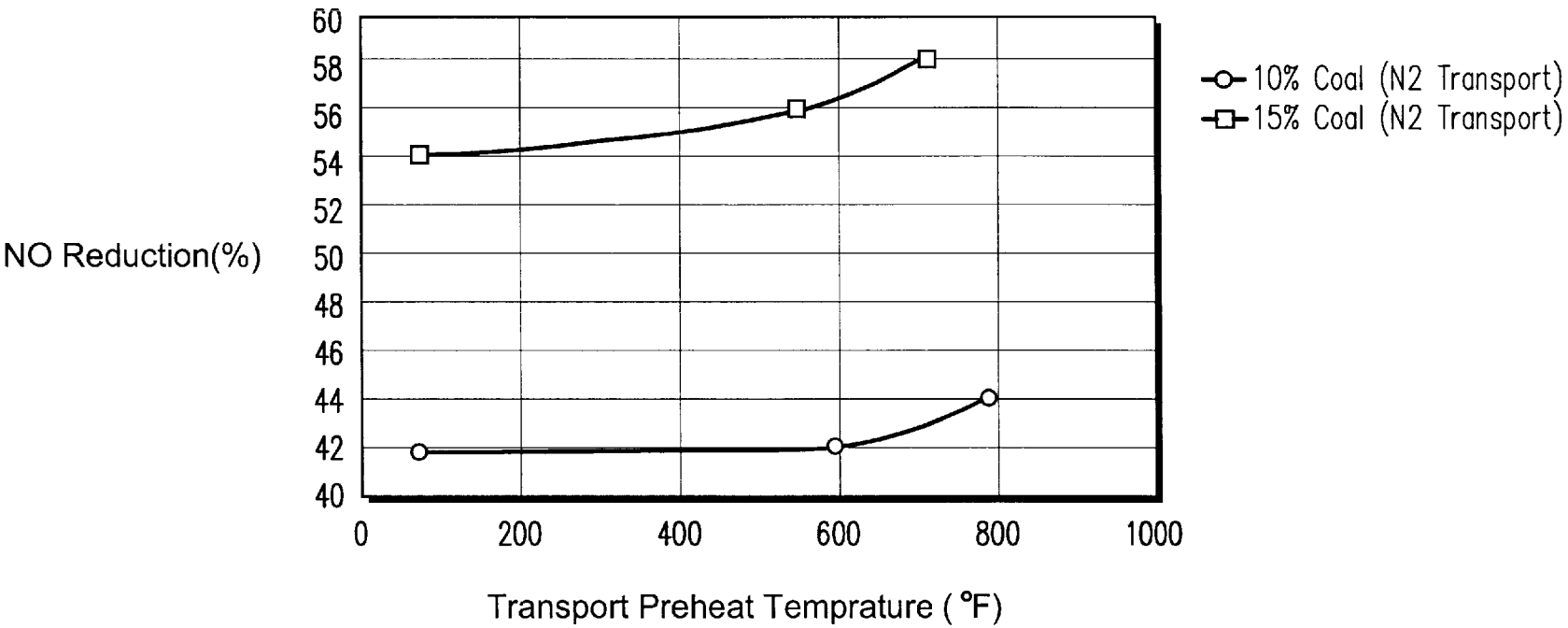
FIG. 4 is a plot of transport preheat temperature vs. NOx reduction for 10, 15 and 20 percent coal in the partially gasified stream.

The coal employed was a Ukrainian bituminous coal. It contained 1.14% sulfur, 24.22% volatiles, 30.64% fixed carbon, and 41.14% ash on a dry basis. Nitrogen was used as the coal transport medium. The nitrogen was preheated by a combination of electrical heating and passing the stream through a tube in the furnace. Residence time of the coal stream in the heated nitrogen before entering the furnace was approximately 1 second. Test variables included secondary fuel heat input, which was varied from 10% to 20%, and transport stream preheat temperature, which was varied from ambient to 800° F. As shown in FIG. 4, NOx reduction increased with increasing preheat temperature, most notably at the higher coal heat inputs. At 15% coal, NOx reduction increased from 54% to 59% as flue gas transport temperature increased from ambient to 720° F. At 20% coal, NOx reduction increased from about 62% to about 65% as flue gas transport temperature increased from ambient to about 530° F. It is noted that due to limitations in the preheating equipment, 800° F. preheat could only be achieved for the lowest secondary fuel heat input. Analysis has shown that while some coal transformations begin at low temperatures, pyrolysis and gasification reactions begin at temperatures in the range of 700° F.

Thus, it is apparent that further increasing temperature at the higher secondary fuel heat inputs will provide further performance benefits. These experiments confirm the basic efficacy of the in-duct coal gasification technology and also point out key test parameters that define process performance. Furthermore, no operational problems, such as fuel line plugging, were encountered during these tests.

Modeling—To demonstrate the application of this technology and its impact on carbon-in-ash content in coal-fired boilers employing LNB, a computational model was used to simulate a 70 MW maximum continuous rate (MCR) boiler. The simulated boiler consists of a waterwall, secondary superheater and reheater above the arch, and a primary superheater in the backpass region. A typical bituminous coal was used as fuel for two burner rows placed approximately nine feet apart in the lower furnace. Nominal MCR operating conditions were simulated first (baseline case) as a basis for comparison to conditions simulating partial in-duct coal gasification with recirculated flue gas and particulate separation. That is volatiles are injected at the upper burner and coal/collected char are injected at the lower burner (similar to condition in FIG. 2). A stoichiometric ratio of 1.18 was applied to both burner rows and was held constant for both operating conditions. This required shifting air to the lower burner row for the proposed technology conditions.

The analysis was performed with a two-dimensional furnace heat transfer and a combustion model applied in conjunction with a one-dimensional boiler performance model. A converged solution of the furnace heat transfer code yielded heat transfer parameters required to evaluate overall boiler performance, such as furnace wall and radiant heat exchanger surface heat absorption and exit gas temperature. These values were subsequently used in the boiler performance code to predict steam-side performance parameters (e.g., attemperation flow rates and water/steam temperatures) The output of the two models provided an estimate of the potential impacts of in-duct coal gasification on carbon-in-ash content and boiler steam-side performance.

Relative to baseline conditions, the model predicts that in-duct coal gasification with 5% upper burner flue gas recirculation, will reduce the carbon-in-ash from 8.5 to 4.4. percent, primarily due to the higher char residence time in the lower furnace and constant burner stoichiometric ratio. The predictions also indicate that there are no significant changes in boiler steam-side operating conditions. The furnace exit gas temperature (FEGT) decreases by 41° F. relative to baseline conditions due to the additional 5 percent FGR sensible heating requirement in the upper burner row. However, the higher boiler mass flow rate with FGR reduces the backpass gas temperature drop yielding higher economizer and air heater outlet temperatures, convection coefficients, and heat duties.

With regard to the impact of in-duct coal gasification on the ASME heat loss efficiency, relative to baseline conditions, the boiler efficiency is predicted to increase by 0.34%. Although the dry gas heat loss increases due to the higher air heater outlet temperature, the reduction in unburned combustible heat loss is large enough to yield an overall improvement in heat loss efficiency.

Thus, calculations show that relative to baseline operating conditions, in-duct coal gasification with 5% FGR can reduce carbon-in-ash and increase heat loss efficiency while maintaining close to nominal steam-side operating conditions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of decreasing concentration of nitrogen oxides and carbon loss in a combustion flue gas comprising:

a) providing a boiler having a combustion zone;

b) providing a plurality of burners in a lower level of said combustion zone and one or more burners in an upper level of said combustion zone;

c) injecting combustible solid fuel and an oxidizing agent into said plurality of burners in the lower level of said combustion zone;

d) partially gasifying solid fuel particles in a duct upstream of said one or more burners in said upper level of said combustion zone by mixing the solid fuel particles with recycled flue gas at a temperature of 600–900° F.; and e) injecting the partially gasified solid fuel into at least one of said one or more burners in said upper level of said combustion zone.

2. The method of claim 1 wherein said combustible solid fuel comprises coal.

3. The method of claim 1 wherein said partially gasified solid fuel comprises partially gasified coal.

4. The method of claim 1 wherein said oxidizing agent comprises air.

5. The method of claim 1 wherein said solid fuel particles comprise coal.

6. A method of decreasing concentration of nitrogen oxides and carbon loss in a combustion flue gas comprising:

a) providing a boiler having a combustion zone;

b) providing a plurality of burners in a lower level of said combustion zone and one or more burners in an upper level of said combustion zone;

c) injecting combustible solid fuel and an oxidizing agent into said plurality of burners in the lower level of said combustion zone; and d) injecting partially gasified solid fuel into at least one of said one or more burners in said upper level of said combustion zone;

wherein said partially gasified solid fuel is separated into combustible volatiles and char prior to step d), and the char is subsequently conveyed to said plurality of burners in the lower level of said combustion zone.

7. A method of decreasing concentration of nitrogen oxides and carbon loss in a combustion flue gas comprising:

a) providing a combustion zone including a primary zone, a reburning zone and a burnout zone;

b) providing a plurality of burners in the primary zone;

c) injecting a combustible solid fuel and an oxidizing agent into said plurality of burners in the primary zone;

d) partially gasifying solid fuel particles in a duct upstream of said one or more burners by mixing the solid fuel particles with recycled flue gas at a temperature of 600–900° F.; and e) injecting partially gasified coal into said reburning zone, downstream of said primary zone.

8. The method of claim 7 wherein air is injected into said burnout zone, downstream of the reburning zone.

9. The method of claim 7 wherein said solid fuel particles comprise coal.

10. A method of decreasing concentration of nitrogen oxides and carbon loss in a combustion flue gas comprising:

a) providing a combustion zone including a primary zone, a reburning zone and a burnout zone;

b) providing a plurality of burners in the primary zone;

c) injecting a combustible solid fuel and an oxidizing agent into said plurality of burners in the primary zone; and d) injecting partially gasified coal into said reburning zone, downstream of said primary zone;

wherein said partially gasified solid fuel is separated into combustible volatiles and char prior to step d), and the char is subsequently conveyed to one or more of said plurality of burners in said primary zone.

11. The method of claim 10 wherein air is injected into said burnout zone, downstream of the reburning zone.

12. A method of decreasing concentration of nitrogen oxides and carbon loss in a combustion flue gas comprising:

a) providing a boiler having a combustion zone;

b) providing a plurality of burners in a lower level of said combustion zone and one or more burners in an upper level of said combustion zone;

c) injecting coal and an oxidizing agent into said plurality of burners in said lower level of said combustion zone to produce a combustion flue gas;

d) partially gasifying solid fuel particles in a duct upstream of said one or more burners by mixing the solid fuel particles with recycled flue gas at a temperature of 600–900° F.; and e) injecting partially gasified coal into at least one of said one or more burners in said upper level of said combustion zone.

13. Apparatus for minimizing NOx emissions and carbon loss in solid fuel combustion comprising:

a boiler having an inlet, a combustion zone, and an outlet;

a plurality of burners arranged in a lower level of said combustion zone and one or more burners in an upper level of said combustion zone;

means for supplying air and solid fuel to said plurality of burners in said lower level of said combustion zone;

partially gasifying solid fuel particles in a duct upstream of said one or more burners in said upper level of said combustion zone by mixing the solid fuel particles with recycled flue gas at a temperature of 600–900° F.; and injecting the partially gasified solid fuel into at least one of said one or more burners in said upper level of said combustion zone.

14. Apparatus of claim 13 and further comprising means for separating said partially gasified solid fuel into volatiles and char prior to injection into said at least one or more burners in said upper level of said combustion zone, and for supplying the char to said plurality of burners in said lower level of said combustion zone.

15. The apparatus of claim 13 and further comprising one or more heat exchangers downstream of said combustion zone and upstream of said outlet.

16. Apparatus for minimizing NOx emissions and carbon loss in solid fuel combustion comprising:

a boiler having an inlet, a combustion zone, and an outlet;

a plurality of burners arranged in a lower level of said combustion zone and one or more burners in an upper level of said combustion zone;

means for supplying air and solid fuel to said plurality of burners in said lower level of said combustion zone;

means for supplying partially gasified solid fuel to at least one of said one or more burners in said upper level of said combustion zone, including a cyclone separator upstream of said at least one burner in said upper level of said combustion zone for separating said partially gasified solid fuel into volatiles and char; and means for supplying the char to said plurality of burners in said lower level of said combustion zone.

17. The apparatus of claim 16 including means for injecting the volatiles into at least one of said one or more burners in said upper level of said combustion zone and means for injecting the char into one or more of said plurality of burners in said lower level of said combustion zone.

18. Apparatus for minimizing NOx emissions and carbon loss in solid fuel combustion comprising:

a boiler having an inlet, a combustion zone, and an outlet wherein said combustion zone includes a primary zone, a reburning zone and a burnout zone;

a plurality of burners arranged in said primary combustion zone;

means for supplying air and solid fuel to said plurality of burners in said primary zone;

means for supplying partially gasified solid fuel to said reburning zone, including means for separating solid residue from said partially gasified solid fuel and supplying said solid residue to at least one of said plurality of burners in said primary zone; and means for supplying the char to said plurality of burners in said primary combustion zone.

* * * * *